United States Patent [19]

Hüsges et al.

[11] 3,977,535

[45] Aug. 31, 1976

[54] APPARATUS FOR LOADING A WORKPIECE STACK INTO A PLATEN PRESS

[75] Inventors: Walter Hüsges, Niederkruchten; Manfred Posselt, Viersen, both of Germany

[73] Assignee: G. Siempelkamp & Co., Krefeld, Germany

[22] Filed: Dec. 16, 1974

[21] Appl. No.: 533,219

[30] Foreign Application Priority Data

Dec. 21, 1973 Germany ..... 2363795

[52] U.S. Cl. ..... 214/1 BB; 156/538; 100/196; 271/205

[51] Int. Cl.[2] ..... B66C 1/22

[58] Field of Search ..... 214/1 BB, 1 P, 1 PL, 214/6 K, 8.5 C; 271/85, 18, 205; 100/196, 215; 198/218

[56] References Cited

UNITED STATES PATENTS

| | | | |
|---|---|---|---|
| 2,958,431 | 11/1960 | Curtenius | 214/6 K |
| 3,556,315 | 1/1971 | Berger | 214/1 BB |
| 3,842,990 | 10/1974 | Posselt | 214/1 BB |
| 3,887,082 | 6/1975 | Posselt | 214/1 BB |

*Primary Examiner*—Albert J. Makay
*Attorney, Agent, or Firm*—Karl F. Ross; Herbert Dubno

[57] ABSTRACT

A stack of sheets is loaded between the platens of a press by an apparatus which grips the stack along its opposite edges flanking a transport direction and holds the stack by these edges as it displaces the stack in the transport direction between the platens. Thereafter one of these edges is released to drop this edge onto the lower platen and, once the one edge is on the platen, the other edge is released so as to drop the rest of the stack on the lower platen. The lower platen is heated so as to slightly adhere the lowermost sheet of the stack to this platen and thereby further prevent shifting of the sheets of the stack relative to one another prior to hot-pressing thereof.

1 Claim, 4 Drawing Figures

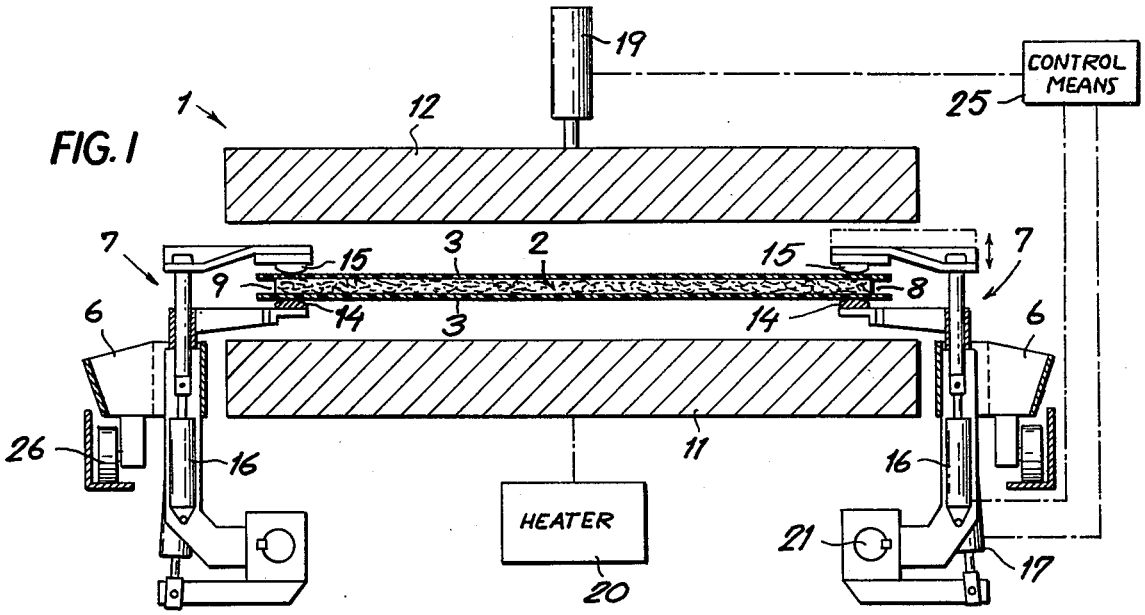
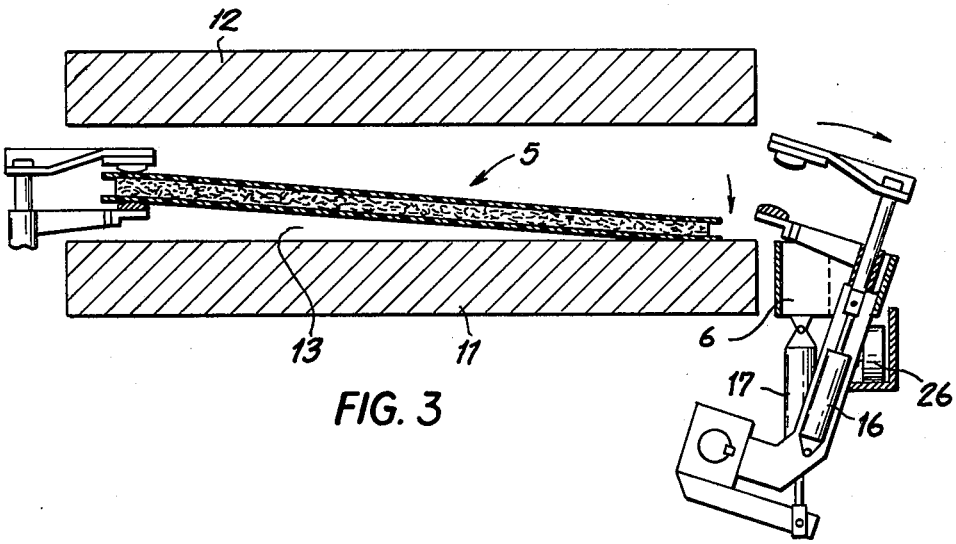
FIG. 3
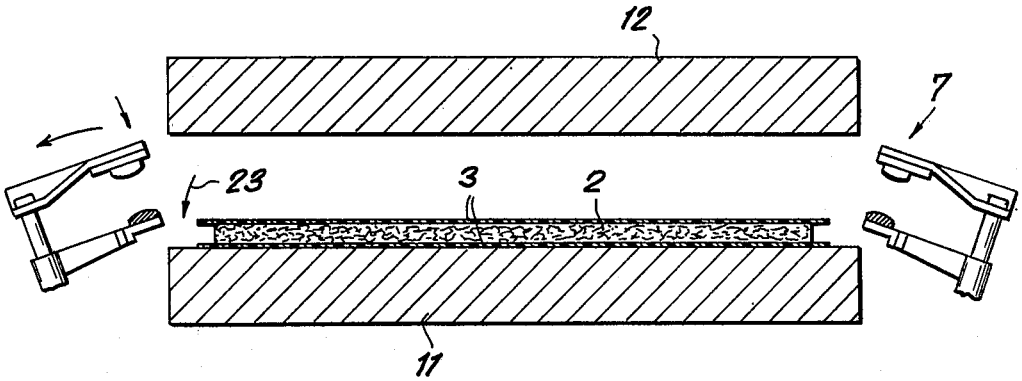
FIG. 4

APPARATUS FOR LOADING A WORKPIECE STACK INTO A PLATEN PRESS

CROSS-REFERENCE TO RELATED APPLICATION

The present application is related to copending patent application Ser. No. 348,013 filed Apr. 5 1973, now U.S. Pat. No. 3,909,343.

FIELD OF THE INVENTION

The present invention relates to an apparatus for loading a stack of sheets into a platen press. More particularly this invention relates to a system for charging a workpiece sandwich comprising a relatively thick core and a pair of outer laminate sheets between the platens of such a press.

BACKGROUND OF THE INVENTION

In the production of pressed laminates having a relatively rigid core sheet made of relatively inexpensive material such as woodchips and having at least one high-quality cover sheet which is integrally bonded with the core usually by means of hot pressing it is necessary that the workpiece stack, or sandwich when two cover sheets are used, be loaded into the press without displacement of the various sheets relative to each other. It is necessary that the core panel remain within the outlines of the two cover sheets.

Traditionally this workpiece stack or sandwich is gripping along opposite edges and displaced horizontally between the platens of the press. Then both edges are released and the stack is dropped a short distance onto the lower press platen.

Such a system has the disadvantage that a cushion of air forms under the dropping stack which slows its fall and frequently causes the sheets to shift relative to one another. This often results in a spoiled product. The difficulty can be avoided by providing extra-large cover sheets so that even a moderate shifting of the core sheet will not spoil the workpiece as this core sheet will nontheless remain between the cover sheets. However this latter system is disadvantageous in that it increases the overall cost of the product due to the oversized expensive cover sheets, and requires troublesome trimming operations.

OBJECTS OF THE INVENTION

It is therefore an object of the present invention to provide an improved apparatus for loading a workpiece stack into a platen press.

Yet another object of the present invention is the provision of such a system which charges a workpiece stack or sandwich between the platens of such a press without allowing any substantial shifting between the workpieces in the stack.

Yet another object is the provision of such a system wherein the workpiece is set on the lowermost platen without its separate components shifting relative to one another.

SUMMARY OF THE INVENTION

These objects are attained according to the present invention in a system wherein the workpiece or stack is gripped along opposite edges flanking a transport direction. Thereafter the workpiece is held by these edges and transported between the platens of the press. Then only one of the workpiece edges is released by the respective clamp so that this edge drops down onto the lower platen. Thereafter the other workpiece edge is released by the respective clamp so that the rest of the workpiece falls onto the lower platen. In this manner as the first-released edge comes to rest on the lower platen the workpieces are prevented from shifting relative to one another by the opposite clamp. Then when this clamp releases, the workpieces do not tend to shift relative to one another as they are already lying at least partially on the lower platen.

In accordance with yet another feature of this invention the lower cover sheet is made of synthetic-resin material and the lower platen is heated such that this lowermost sheet of the workpiece stack tends to adhere to the lower platen. Thus as the one edge is dropped it adheres or sticks to the lower platen so that any shifting of the workpiece components relative to one another when the other edge is released is ruled out.

The invention allows the manufacture of high-quality laminate boards with virtually none of the boards spoiled due to workpiece shifting caused by the operation of loading the stack into the platen press where it is hot-pressed. Due to the precision with which the system operates it is possible to use cover sheets which are only slightly larger than the core sheet. Thus the trimming operation downstream of the hot press is substantially simplified and workpiece cost is reduced.

The apparatus according to the present invention comprises a large frame displaceable in the transport direction and having at its upstream end along each side of the clamps which grips the workpiece edge and having at its downstream end a plurality of suction lifters as described in the above-cited patent application and the patents and applications cited therein. The frame is displaceable between an upstream position wherein the clamp lies at an upstream loading station and the lifters are engageable in the press and a downstream position wherein the clamps lie within the press and the lifters are at an unloading location downstream of the press. This frame is reciprocated back and forth between the closings of the press so that each time it moves downstream it picks a hot-press workpiece stack out of the press and displaces it downstream into the unloading station while displacing a fresh unpressed stack into the press. The vacuum lifters are pivotal out between the press platens to allow them to close.

BRIEF DESCRIPTION OF THE DRAWING

The above and other objects, features, and advantages of the invention will become more readily apparent from the following description, reference being made to the accompanying drawing in which:

FIG. 1 is a vertical section through the apparatus according to the present invention;

FIGS. 3 and 4 are views similar to FIG. 1 illustrating the operation of the system in accordance with this invention.

SPECIFIC DESCRIPTION

Figure 2:
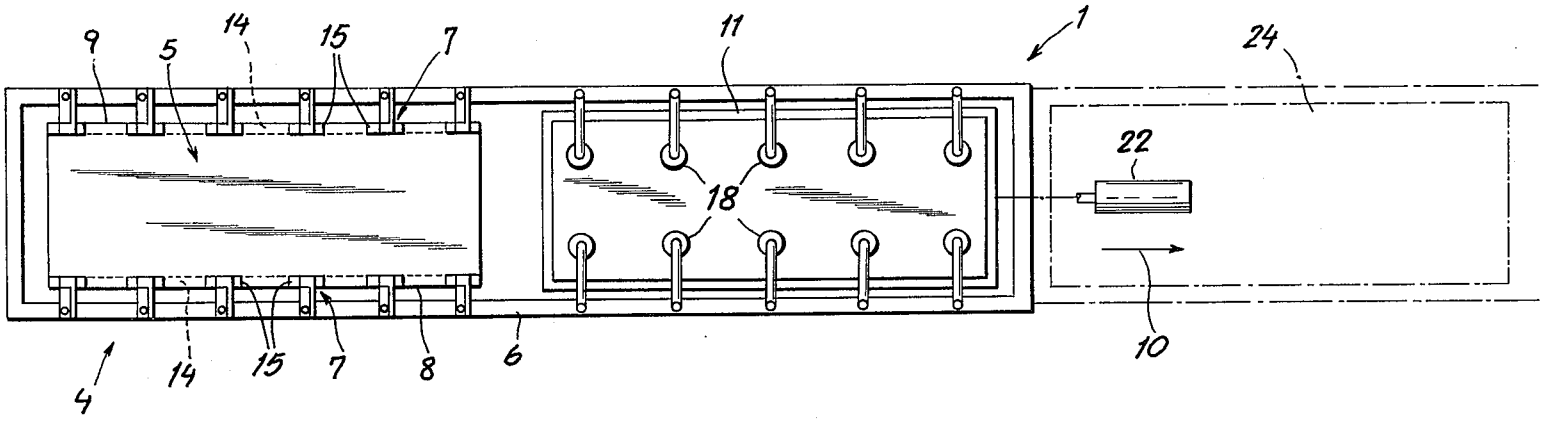
FIG. 2 is a top view in reduced scale showing the apparatus of FIG. 1.

As shown in FIGS. 1 and 2 a two-platen press 1 is employed for hot-pressing a workpiece stack 5 comprising a relatively thick and rigid core sheet 2 formed of fiberboard and a pair of relatively thin high-quality synthetic-resin cover sheets 3 sandwiching this board 2. A rectangular loading frame 6 provided with clamps 7 that engage opposite longitudinal ends 8 and 9 of the stack 5 is displaceble on rollers 26 in a transport direction 10 between the platens 11 and 12 of the press 1.

The clamps 7, six of which are provided on each side of the stack 5, each comprise an upper jaw 15 vertically displaceable by means of a respective pneumatic cylinder 16, and the lower jaw 14 fixed under the jaw 15. All of the clamps 7 along each side are controlled by a pneumatic cylinder 17 which can tip them about respective axes 21 located under the press substantially below the workpiece edges 8 and 9. The jaw 14 is continuous along each side of the stack 5 whereas separate bar-shaped jaws 15 are provided along the sides 8 and 9.

In operation the cylinders 16 are first actuated by a controller 25 to grasp a stack 5 in the station 4. Then the frame 6 is displaced by means of a drive such as the cylinder shown at 22 in FIG. 2 downstream in the direction 10 so as to move the stack 5 between the platens 11 and 12 and hold it there as shown in FIG. 1. Thereafter the cylinders 16 along the side 8 are pressurized with air so as to lift the jaws 15. The corresponding cylinder 17 for the side 8 is then also pressurized so as to tip the clamp 7 and drop the edge 8 onto the lower platen 11 as shown in FIG. 3. This lower platen 11 is heated by an apparatus shown at 20. A wedge-shaped cushion 13 of air is then formed under the workpiece stack 5 which is driven out as the other clamps 7 are opened and swung out from between the platens 11 and 12. The workpiece stack 5 then drops down as shown by arrow 23 onto the lower platen 11. A cylinder 19 is then actuated to lower the platen 12 and thereby press the stack 5.

The sheets 3 are of a synthetic-resin which adheres slightly to the heated platen 11 so that when the edge 8 is dropped against this platen 11 the stack 5 tends to adhere thereto along this edge 8. This adherence prevents the core 2 and sheets 3 from shifting relative to each other as the other edge 9 is dropped.

After the operation is complete the press is opened and the lifters 18 are swung between the platens 11 and 12 so as pneumatically to lift up the completed workpiece. The frame 6 is then moved downstream to place the board in the downstream unloading station 24.

We claim:

1. The combination, with a platen press and an assembly table horizontally spaced from said press for assembling a stack of sheets for the formation of a laminated board wherein the stack is transferred from said table between the platen of said press, of a stack-transfer device which comprises:

a pair of horizontal beams horizontally spaced apart and adapted to flank said table and said press;

guide means forming a horizontal longitudinal transport path for said beams between a pickup position wherein said beams lie adjacent said table and a deposit position wherein said beams lie adjacent said press;

at least one clamp arrangement mounted on each of said beams for engagement with opposite edges of said stack in said pickup position and adapted to release said stack in said deposit position, each of said clamp arrangements comprising:

a double-arm angular lever fulcrumed on a respective horizontal axis to the respective beam;

a pair of clamp jaws mounted on one of the arms of said lever and adapted to grip the respective edge of the stack between them;

actuation means on said one of said arms for displacing one of said jaws toward and away from the other of said jaws for respectively engaging and releasing the respective edge of said stack, and a fluid-responsive piston-and-cylinder mechanism of each beam operatively connected to the other arm of the respective lever for swinging same between laminating positions wherein said jaws are withdrawn laterally from between platens of said press, respectively;

control means synchronously operating said press, said actuating means and said fluid responsive mechanism for successively:

opening the jaws of one of said clamp arrangements, swinging the jaws thereof out from between said platens, opening the jaws of the other clamp arrangement and swinging the jaws thereof out from between the press platens for each cycle of press closure, said control means releasing one of said edges to drop same onto the lower platen and thereafter releasing the other edge of said stack to drop the rest of said stack onto said lower platen.

* * * * *